US009951940B2

(12) United States Patent
Hui et al.

(10) Patent No.: US 9,951,940 B2
(45) Date of Patent: Apr. 24, 2018

(54) FLOATING ILLUMINATION DEVICE FOR A SWIMMING POOL OR OTHER BODY OF WATER AND METHOD THEREFOR

(71) Applicants: Wing-Tak Hui, Hong Kong (CN); Andrew Matthew Hui, San Jose, CA (US); Martin Wing-Kin Hui, Hong Kong (CN)

(72) Inventors: Wing-Tak Hui, Hong Kong (CN); Andrew Matthew Hui, San Jose, CA (US); Martin Wing-Kin Hui, Hong Kong (CN)

(73) Assignee: COMPUROBOT TECHNOLOGY COMPANY, Dongguan (CN)

( * ) Notice: Subject to any disclaimer, the term of this patent is extended or adjusted under 35 U.S.C. 154(b) by 47 days.

(21) Appl. No.: 14/962,672

(22) Filed: Dec. 8, 2015

(65) Prior Publication Data

US 2017/0159927 A1 Jun. 8, 2017

(51) Int. Cl.

| | |
|---|---|
| ***F21V 31/00*** | (2006.01) |
| ***E04H 4/14*** | (2006.01) |
| ***F21S 9/03*** | (2006.01) |
| *F21L 4/08* | (2006.01) |
| *F21W 131/401* | (2006.01) |

(52) U.S. Cl.

CPC ..... *F21V 31/00* (2013.01); *E04H 4/148* (2013.01); *F21S 9/037* (2013.01); *F21V 31/005* (2013.01); *F21L 4/08* (2013.01); *F21W 2131/401* (2013.01)

(58) Field of Classification Search

CPC . F21V 31/00; F21V 31/005; F21W 2131/308; F21W 2131/401; E04H 4/148; B63B 45/00; B63B 45/02; B63B 2045/005

USPC ..... 362/158, 267

See application file for complete search history.

(56) References Cited

U.S. PATENT DOCUMENTS

| | | | | |
|---|---|---|---|---|
| 2,109,813 A * | 3/1938 | Winckler | B63C 9/20 | 362/191 |
| 3,748,457 A * | 7/1973 | Balitzky | B63B 22/166 | 362/158 |
| 3,833,955 A * | 9/1974 | Hulbert, Jr. | F21S 8/00 | 362/253 |
| 5,362,267 A * | 11/1994 | Forrest | B63B 22/166 | 362/341 |
| 7,458,698 B2 * | 12/2008 | Heathcock | B44C 5/005 | 362/101 |

(Continued)

FOREIGN PATENT DOCUMENTS

CN 201100570 Y * 8/2008

OTHER PUBLICATIONS

Lin, Multi-purpose water pool lamp structure, Aug. 13, 2008, CN Patent CN201100570Y; Google Patents, https://patents.google.com/patent/CN201100570Y/en.*

*Primary Examiner* — Elmito Breval
*Assistant Examiner* — Michael Chiang
(74) *Attorney, Agent, or Firm* — Weiss & Moy, P.C.; Jeffrey D. Moy

(57) ABSTRACT

A floating illumination device for a water feature has a housing having a sub-housing extending down from a bottom section of the housing. A lighting circuit is held by the sub-housing. A plurality of illuminating elements of the lighting circuit is attached to an outer perimeter of the sub-housing. A cover is positioned over the sub-housing forming a watertight seal.

15 Claims, 6 Drawing Sheets

(56) References Cited

U.S. PATENT DOCUMENTS

| | | | | |
|---|---|---|---|---|
| 2006/0092630 | A1* | 5/2006 | Kennedy | F21S 8/00 362/157 |
| 2006/0176686 | A1* | 8/2006 | McVicker | F21S 9/022 362/183 |
| 2007/0230161 | A1* | 10/2007 | Longoria | F21S 8/00 362/101 |
| 2008/0266860 | A1* | 10/2008 | Marcinkewicz | B63B 45/02 362/253 |
| 2010/0232145 | A1* | 9/2010 | Liu | A01K 97/02 362/157 |
| 2011/0026264 | A1* | 2/2011 | Reed | F21V 29/004 362/373 |
| 2014/0111998 | A1* | 4/2014 | Miller | F21V 15/01 362/267 |

* cited by examiner

FLOATING ILLUMINATION DEVICE FOR A SWIMMING POOL OR OTHER BODY OF WATER AND METHOD THEREFOR

TECHNICAL FIELD

The present application generally relates to an illumination device, and more specifically, to a floating illumination device for use in a swimming pool or other bodies of water to illuminate a portion of the body of water around where the floating illumination device is located for safety and/or decorative purposes.

BACKGROUND

Many swimming pools incorporate lighting elements. In the past, swimming pool lighting elements were generally limited to underwater lighting elements which were formed within the swimming pool wall. These types of swimming pool lighting elements generally required an electrical power supply. Typically, the electrical power may be provided underground from an adjacent building, with an access point known as a deck box (usually water proof) adjacent the swimming pool. For swimming pools having multiple in wall lighting elements, multiple deck boxes may be provided around the perimeter of the swimming pool.

Initially pool lighting was used strictly for safety purposes. Night time swimming, although not terribly popular, was done with much greater safety at night with lighted pools for obvious reasons. However, recently, pool lighting has become more and more popular. Such lighting may enhance the ambiance during evening hours. This may especially be true when pool owners may be dinning or having social gathering outdoors around the swimming pool. Some of these enhancements may include adding color lighting as a feature to swimming pools, as well as adding sequential color lighting. However, these enhancements are generally used with the in wall lighting elements.

Further, with the increased installation of backyard garden ponds, fishponds and other water features, homeowners are looking for lighting alternatives that will enhance these areas during night hours and especially during outdoor social gathering. In general, any lighting elements associated with backyard garden ponds, fishponds and other water features are built into these water features.

Therefore, it would be desirable to provide a device and method that overcomes the above. The device and method would provide illumination of water features without requiring lighting elements to be built into the water feature.

SUMMARY

In accordance with one embodiment, a floating illumination device for a water feature is disclosed. The floating illumination device has a housing having a sub-housing extending down from a bottom section of the housing. A lighting circuit is held by the sub-housing. A plurality of illuminating elements of the lighting circuit is attached to an outer perimeter of the sub-housing. A cover is positioned over the sub-housing forming a watertight seal.

In accordance with one embodiment, a floating illumination device for a water feature is disclosed. The floating illumination device has a housing having a hollow interior and a sub-housing extending down from a bottom surface of the housing. A ridge is formed around a perimeter of a bottom surface of the sub-housing and has one of a flat or downward angled top surface. A plurality of illuminating elements is formed around the ridge. A power source is housed within the sub-housing and coupled to the plurality of illuminating elements. A cover is positioned over the sub-housing forming a watertight seal.

In accordance with one embodiment, a floating illumination device for a water feature is disclosed. The floating illumination device has a housing configured to float on a surface of the water feature. The housing has a tubular member extending down from a bottom section of the housing. A sub-housing is removably coupled to the tubular member extending from the bottom section of the housing. A ridge is formed around a perimeter of a bottom surface of the sub-housing and has one of a flat or downward angled top surface. A plurality of illuminating elements is formed around the ridge. A power source is housed within the sub-housing. A cover is positioned over the sub-housing. A collar is attached to the tubular member forming a watertight seal for the cover.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

Figure 1:
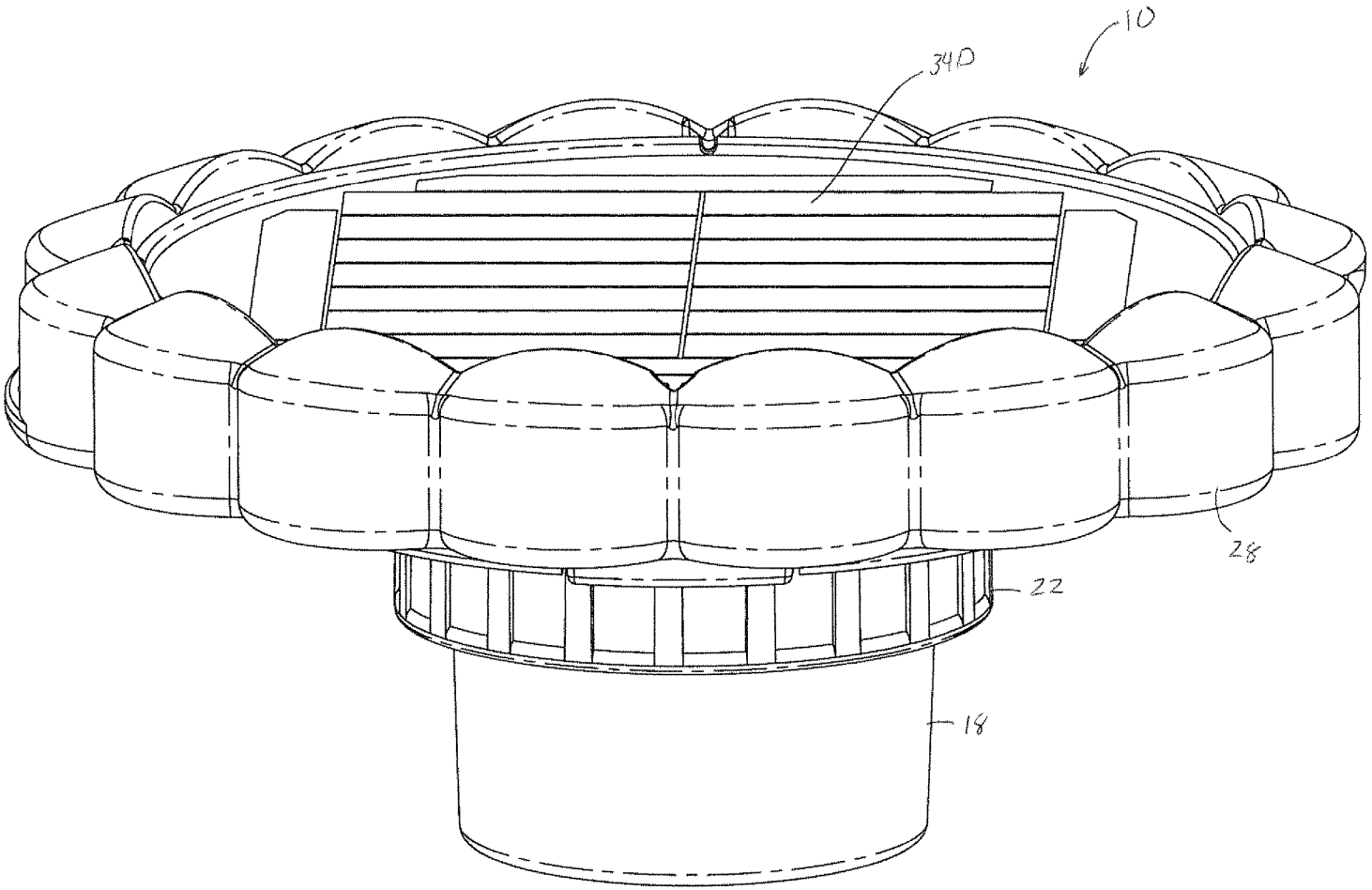
FIG. 1 is a front prospective view of a floating illumination device in accordance with one aspect of the present application.
Figure 2:
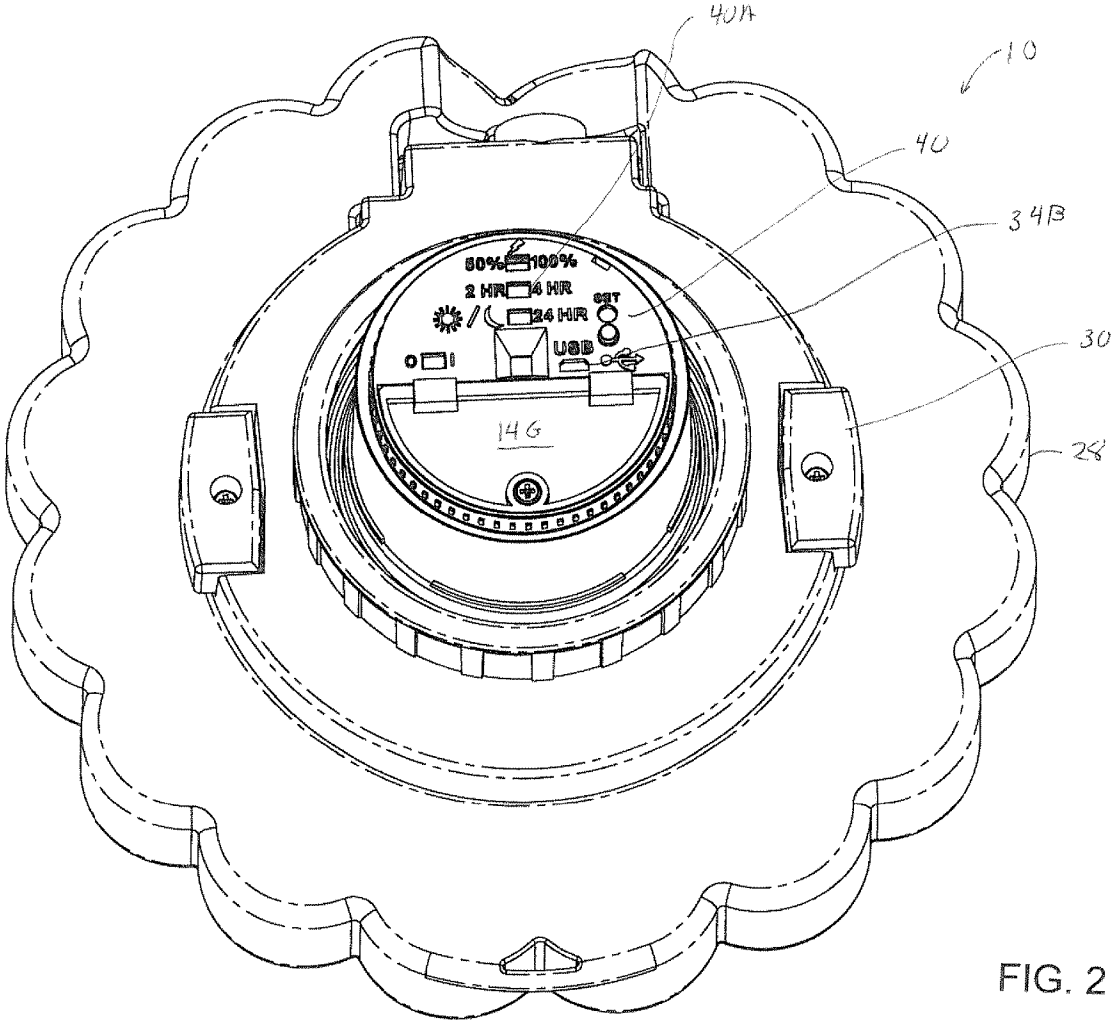
FIG. 2 is a is a bottom view of the floating illumination device of FIG. 1 in accordance with one aspect of the present application.

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure Embodiments of the exemplary device and method provide a floating illumination device for a swimming pool, spa, garden pond, fishpond and other water features. The floating illumination device provides illumination of these water features without requiring lighting elements to be built into the water features. The floating illumination device are self sustaining and once activated requires little to no maintenance.

Referring to FIGS. 1-5, a floating illumination device 10 (hereinafter illumination device 10) is shown. The floating illumination device 10 has a housing 12. The housing 12 may be configured to float on a top surface of water within a swimming pool or other water feature. The housing 12 may have a hollow interior section 12A which may provide the buoyancy to keep the illumination device 10 afloat. A tubular member 12B may extend down from a central bottom area of the housing 12. The tubular member 12B may provide access to the interior section 12A of the housing 12.

A sub-housing 14 may be coupled to the housing 12. In accordance with one embodiment, the sub-housing 14 may be coupled to the distal end 12B' of the tubular member 12B. The sub-housing 14 may be used to store and hold a lighting circuit 16. The sub-housing 14 may have a bottom surface 14G. Sidewalls 14C extend up from the bottom surface 14G forming a hollow interior area 14B having an open top surface 14A. A plurality of leg members 14D may rise up from a top edge of a sidewall 14C forming part of the sub-housing 14. At a distal end of each leg member 14D is a tab member 14E that extends away from the interior area 14B of the sub-housing 14. When securing the sub-housing 14 to the distal end 12B' of the tubular member 12B, the leg members 14D may extend up into an interior of the tubular member 12B. The tab member 14E may engage a bottom surface of the housing 12 where the tubular member 12B extends down from the central bottom area of the housing 12 securing the sub-housing 14 to the tubular member 12B of the housing 12.

A cover 18 may be formed around the sub-housing 14. The cover 18 may be used to prevent water from entering into the sub-housing 14 thereby protecting the lighting circuit 16 from damage. The cover 18 may be similar in shape to the sub-housing 14 but having a wider perimeter to fit around the sub-housing 14.

A securing device 20 may be used to attach the cover 18 to the tubular member 12B of the housing 12, The securing device 20 may form a watertight seal thereby preventing water from entering into the area between the cover 18 and the sub-housing 14. In accordance with one embodiment, the securing device 20 may be formed of a collar 22. The collar 22 may have threading 24 formed around an inner perimeter thereof. The threading 24 may engage threading 26 formed on an outer perimeter of the tubular member 12B of the housing 12 thereby securing the cover 18 to the tubular member 12B of the housing 12. A gasket 29 may be positioned between the tubular member 12B and the sub-housing 14. The gasket 29 may be used to prevent leakage from or into the area between the cover 18 and the sub-housing 14.

A flotation device 28 may be formed around the housing 12. The flotation device 28 may enhance the ability of the housing 12 and hence the illumination device 10 to float. The flotation device 28 may be an air bladder or similar device formed around an outer perimeter of the housing 12. One or more attachment device 30 may be used to secure the flotation device 28 to the housing 12. The attachment device 30 may be locking blocks 30A, screws or similar devices.

Figure 3:
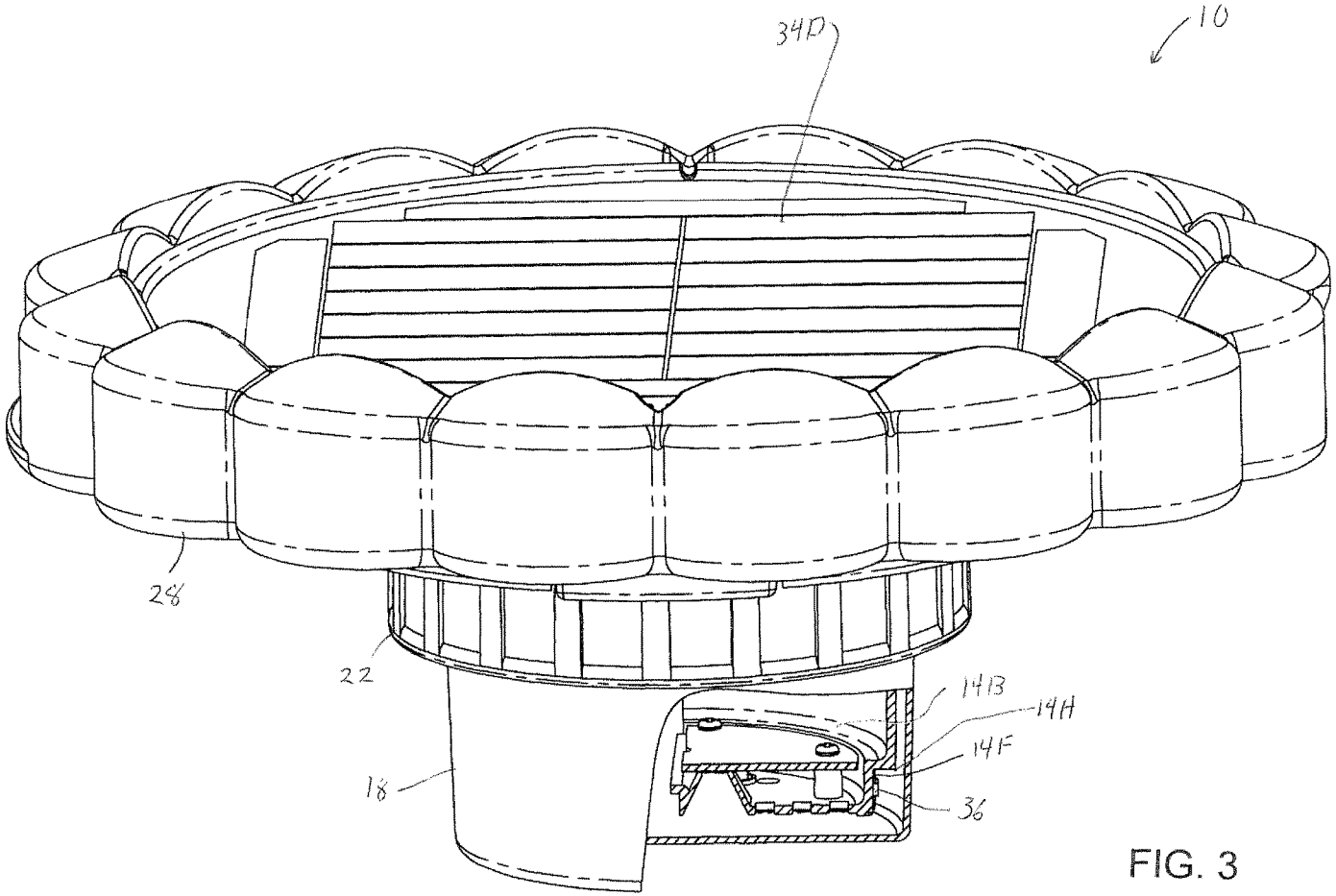
FIG. 3 is a cutaway front perspective view of the floating illumination device of FIG. 1 in accordance with one aspect of the present application.
Figure 4:
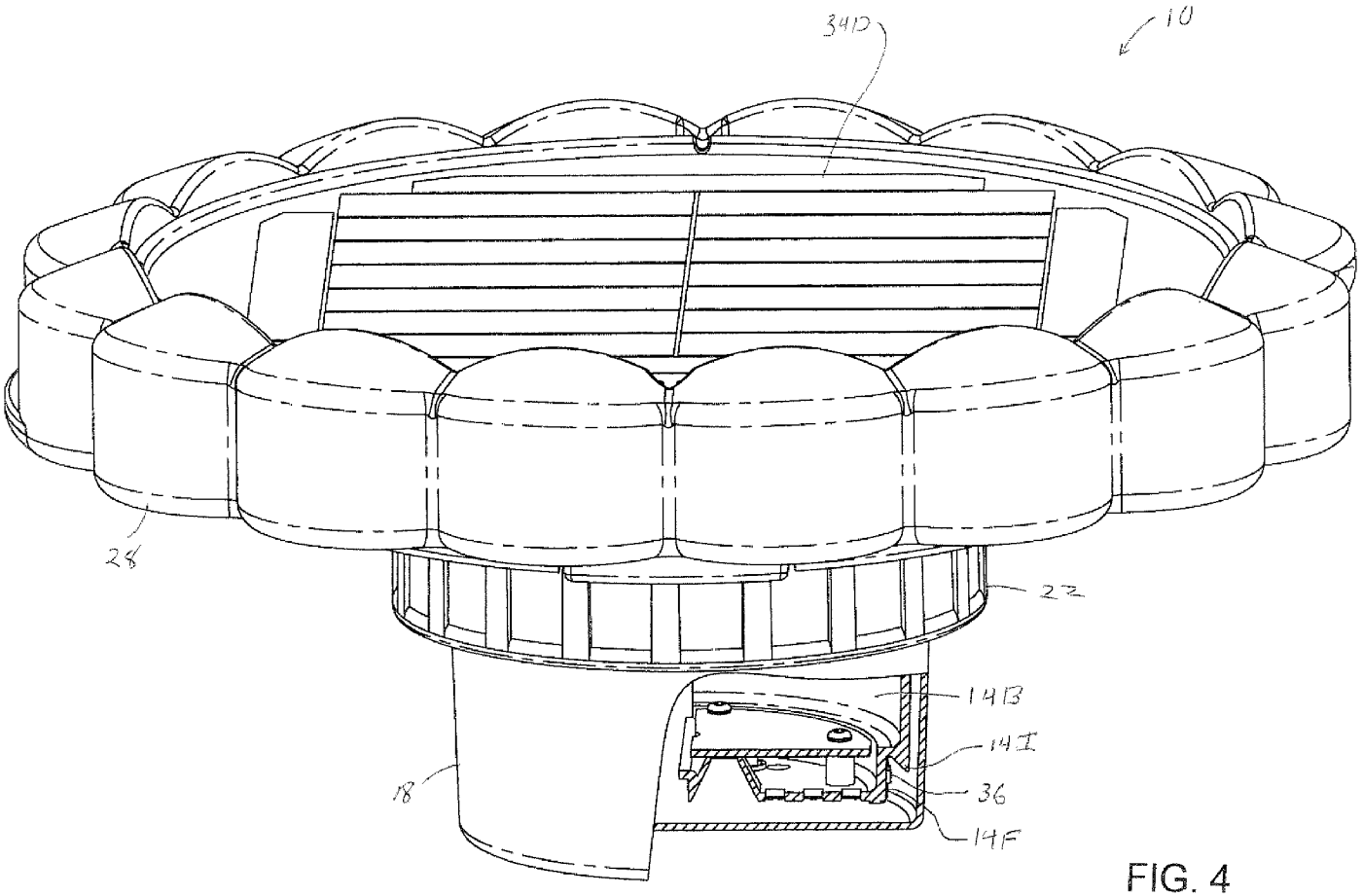
FIG. 4 is a cutaway front perspective view of the floating illumination device of FIG. 1 in accordance with one aspect of the present application.
Figure 5:
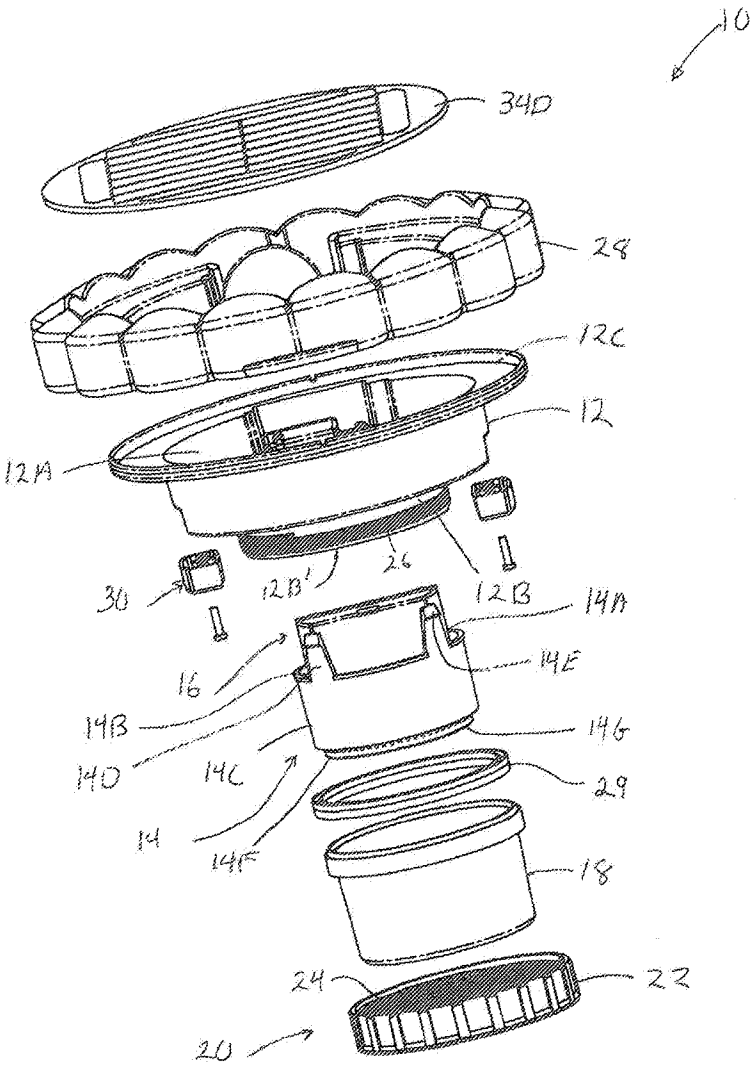
FIG. 5 is an exploded view of the floating illumination device of FIG. 1 in accordance with one aspect of the present application.
Figure 6:
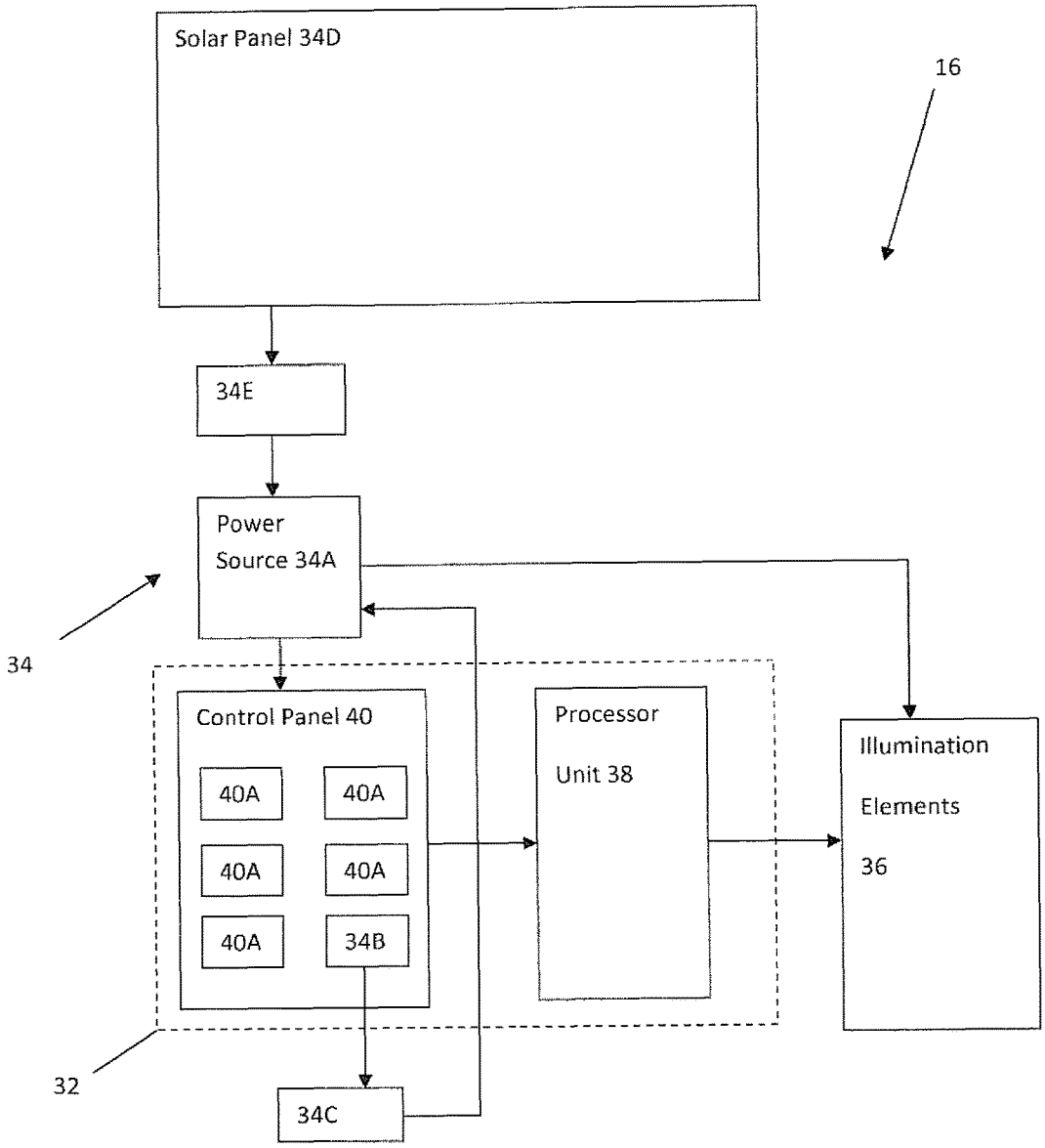
FIG. 6 is a block diagram of a lighting circuit used in the floating illumination device of FIG. 1 in accordance with one aspect of the present application.

Referring to FIGS. 1-6, the lighting circuit 16 may be comprised of a control unit 32, a power supply unit 34 and a plurality of illumination elements 36. As shown most clearly in FIGS. 3-5, the illumination elements 36 may be formed around a bottom outer perimeter of the sub-housing 14. In accordance with one embodiment, the illumination elements 36 may be formed around a ridge 14F which may be formed may be formed around a bottom outer perimeter of the sub-housing 14. A top surface 1411 of the ridge 14F may be flat as shown in FIG. 3 or angled as shown in FIG. 4. An angled top surface 141 of the ridge 14F as shown in FIG. 4 may reflect the light rays from the illumination elements 36 towards the bottom of the swimming pool.

The illumination elements 36 may be coupled to the control unit 32. The control unit 32 may be used to control the operation of the illumination elements 36. The control unit 32 may be used to activate the illumination device 10, set when the illumination elements 36 may be activated, the duration the illumination elements 36 may be illuminated, the intensity of the illumination elements 36 and other similar lighting control features. In accordance with one embodiment, the control unit 32 may be formed of a processor unit 38. The processor unit 38 may be coupled to a control panel 40. As may be seen in FIG. 2, the control panel 40 may be formed on a bottom surface 14G of the sub-housing 14. The control panel 40 may have one or more input device 40A. The input devices 40A may allow a user to enter one or more operating parameters for the illumination device 10. By setting the operating parameters, the control panel 40 indicates to the processor 38 how to control operation of the illumination device 10.

A power supply unit 34 is coupled to the control unit 32 and the plurality of illumination elements 36. The power supply unit 34 may be used to power the components of the illumination device 10. The power supply unit 34 may be comprised of a power source 34A. In accordance with one embodiment, the power source 34A may be a rechargeable battery. If the power source 34A is rechargeable, the power supply unit 34 may have a charging port 34B. The charging port 34B may be used to plug the power source 34A to a recharging source. In the embodiment show, the charging port 34B may be located on the control panel 40. An AC-DC converter 34C may be used to convert AC power from the recharging source to DC power for recharging the rechargeable power source 34A. Alternatively, or in addition to the charging port 34B, the power supply unit 34 may have a solar panel 34D. The solar panel 34D may be coupled to a top surface of the housing 12. In accordance with one embodiment, a ridge 12C may be formed around a top surface of the housing 12. The solar panel 34D may be positioned and held within the ridge 12C. The solar panel 34D may be used to convert energy from the sun to electrical energy for charging the power supply unit 34. A voltage regulator 34E may be used to adjust the voltage generated by the solar panel 34D to the proper level for charging the power supply unit 34.

The foregoing description is illustrative of particular embodiments of the application, but is not meant to be a limitation upon the practice thereof. The following claims, including all equivalents thereof, are intended to define the scope of the application.

What is claimed is:

1. A floating illumination device for a water feature comprising:

a floatable housing having a hollow interior section, a bottom opening formed within a bottom section of the floatable housing;

a tubular member extending down from the floatable housing and in communication with the hollow interior section of the housing through the bottom opening;

a sub-housing positioned within the tubular member and removably attached to the bottom opening, wherein the sub-housing comprises:

a bottom surface;

sidewalls extending up from the bottom surface;

a plurality of leg members extending up from a top end of the sidewalls; and a tab member extending out and away from a top surface of at least one of, the plurality of leg members;

wherein each of the plurality of leg members extend up into an interior of the tubular member, each of the tab members engaging the bottom section of the housing where the tubular member extends down from the housing, securing the sub-housing to the housing;

a lighting circuit held by the sub-housing, wherein a plurality of illuminating elements of the lighting circuit are attached to an outer perimeter of the sub-housing;

a cover having a same shape of the sub-housing, the cover having a wider perimeter than the sub-housing to fit around the sub-housing forming a watertight seal;

a securing device attached to the tubular member securing cover around the sub-housing and forming the watertight seal; and a flotation device formed around, a perimeter of the floatable housing.

2. The floating illumination device of claim 1, comprising a ridge formed around the outer perimeter of a bottom surface of the sub-housing, the plurality of illuminating elements of the lighting circuit attached around a perimeter of the ridge, the ridge having one of a flat top surface or an angled top surface.

3. The floating illumination device of claim 1, wherein the securing device comprises:

a collar having threading formed around an inner perimeter thereof; and tubular member threading formed on an outer perimeter of the tubular member, the threading of the collar engaging the tubular member threading attaching the cover to the tubular member.

4. The floating illumination device of claim 3, wherein the securing device comprises a gasket positioned between the tubular member and the sub-housing.

5. The floating illumination device of claim 1, wherein the lighting circuit comprises:

a control panel attached to a bottom surface of the sub-housing;

a controller coupled to the control panel and housed with the sub-housing; and a power supply circuit coupled to the controller and the plurality of, illuminating elements.

6. The floating illumination device of claim 5, wherein the power supply circuit comprises:

a rechargeable battery; and a charging source coupled to the rechargeable battery.

7. The floating illumination device of claim 6, comprising a ridge formed around a top surface of the hollow housing;

wherein the charging source is a solar panel positioned within e ridge and attached to a top surface of the housing.

8. The floating illumination device of claim 6, wherein the charging source comprises:

a charging port formed on the control panel; and an AC/DC converter coupled tot charging port and the rechargeable battery.

9. A floating illumination device for a water feature comprising:

a floatable housing having a hollow interior, an opening formed in a central bottom area of the floatable housing;

a tubular member extending down from the opening formed in the floatable housing;

a sub-housing removably attached to the floatable housing, the sub-housing positioned within the tubular member, wherein the sub-housing comprises:

a bottom surface;

sidewalk up from the bottom surface;

a plurality of leg members extending up from a top end of the sidewalls; and a tab member extending out and away from a top surface of at least one of the plurality of leg members;

wherein each of the plurality of leg members extend up into an interior of the tubular member, each of the tab members engaging the bottom central area section of the housing, securing the sub-housing to the housing;

a ridge formed around a perimeter of a bottom surface of the sub-housing and having one of a flat or downward angled top surface;

a plurality of illuminating elements formed around the ridge;

a power source housed within the sub-housing and coupled to the plurality of illuminating elements;

a gasket positioned between the tubular ember and the sub-housing;

a cover having a same shape of the sub-housing, the cover having a wider perimeter than the sub-housing to fit around the sub-housing forming a watertight seal;

a securing device attached to the tubular member securing the cover around the sub-housing and forming the watertight seal; and a flotation device formed around a perimeter of the floatable housing.

10. The floating illumination device of claim 9, wherein the securing device comprises:

a collar having threading formed around an inner perimeter thereof; and tubular member threading formed on an outer perimeter of the tubular member, the threading of the collar engaging the tubular member threading attaching the cover to the tubular member.

11. The floating illumination device of claim 9, comprising:

a control panel attached to a bottom surface of the sub-housing; and a controller coupled to the control panel and housed within the sub-housing.

12. The floating illumination device of claim 11, wherein the power source is a rechargeable battery, a charging source coupled to the rechargeable battery.

13. The floating illumination device of claim 12, wherein the charging source is a solar panel attached to a top surface of the housing.

14. The floating illumination device of claim 12, wherein the charging source comprises:

charging port formed on the control panel; and an AC/DC converter coupled to the charging port and the rechargeable battery.

15. A floating illumination device for a water feature comprising:

a housing configured to float on a surface of the water feature, the housing having a tubular member extending down from a bottom section of the housing;

a flotation device formed around a perimeter of the housing;

a sub-housing removably coupled to the tubular member extending from the bottom section of the housing, wherein the sub-housing comprises:

a bottom surface;

sidewalls extending, up from the bottom surface;

a plurality of leg members extending up from a top end of the sidewalls; and a tab member extending out and away from a top surface of at least one of the plurality of leg members;

wherein each of the plurality of leg members extend up into an interior of the tubular member, each of the tab members engaging the bottom section of the housing;

a ridge formed around a perimeter of a bottom surface of the sub-housing and having one of a flat or downward angled top surface;

a plurality of illuminating elements formed around the ridge;

a power source housed within the sub-housing;

a cover having a same shape of the sub-housing, the cover having a wider perimeter than the sub-housing to fit around the sub-housing forming a watertight seal; and a collar attached to the tubular member securing the cover around the sub-housing and forming a watertight seal for the cover.

* * * * *